United States Patent [19]

Bagnall-Wild et al.

[11] Patent Number: 4,760,770

[45] Date of Patent: Aug. 2, 1988

[54] FIRE CONTROL SYSTEMS

[75] Inventors: Ralph H. Bagnall-Wild, Helensburgh, Scotland; Clinton E. Evans, Taunton, England; Gordon R. Smith, Glasgow, Scotland

[73] Assignee: Barr & Stroud Limited, Glasgow, Scotland

[21] Appl. No.: 544,865

[22] Filed: Oct. 3, 1983

[30] Foreign Application Priority Data

Nov. 17, 1982 [GB] United Kingdom ..... 8232786

[51] Int. Cl.[4] ..... F41G 1/00; F41H 7/00

[52] U.S. Cl. ..... 89/41.19; 89/40.03; 89/41.06; 356/152; 364/423

[58] Field of Search ..... 89/41 L, 41 ME, 41 M, 89/41 E; 356/29, 152, 251, 252; 235/414; 364/423

[56] References Cited

U.S. PATENT DOCUMENTS

| | | | |
|---|---|---|---|
| 3,684,383 | 8/1972 | Johansson | 89/41.03 |
| 3,845,276 | 10/1974 | Kendy et al. | 89/41.22 X |
| 3,953,132 | 4/1976 | Michelson | 89/41.06 X |
| 3,997,762 | 12/1976 | Ritchie et al. | 89/41.19 X |
| 4,020,739 | 5/1977 | Piotrowski et al. | 89/41.03 |
| 4,142,799 | 3/1979 | Barton | 89/41.03 X |
| 4,266,463 | 5/1981 | Soltin | 89/41.06 |
| 4,402,250 | 9/1983 | Baasch | 364/423 X |
| 4,404,890 | 9/1983 | McAlpine | 89/41.19 |
| 4,422,758 | 12/1983 | Godfrey et al. | 356/152 |
| 4,494,198 | 1/1985 | Smith et al. | 364/423 |

*Primary Examiner*—David H. Brown

*Attorney, Agent, or Firm*—Finnegan, Henderson, Farabow, Garrett & Dunner

[57] ABSTRACT

A fire control system comprises a platform (10) rotatable in azimuth on which are mounted a gun (11) first and second sighting devices (15,25) each of which is movable in elevation, each sighting device (15,25) having its sight line nominally aligned with the barrel axis of the gun (11), the first sighting device (15) incorporates a lens (39) defining the sight line thereof, a graticule (41) defining an alignment mark and a mechanism (19,20) coupled to the lens (29) for alignment adjustment. Gun (11) comprises a muzzle reference mirror (12) and the first sighting device (15) incorporates a direction-finding means which is arranged to enable the position of an image in the muzzle reference mirror (12) to be identified with respect to the alignment mark of the graticule (41), the mechanism (19,20) being operable to effect alignment of that mark with the image seen in the muzzle reference mirror position. Mechanism (19,20) further comprises signal-generating sensors (21,22) arranged automatically to provide alignment adjustment identification signals which are processed to provide an electronic graticule in the second sighting device (25) so that the sight line of the second sighting device (25) is automatically aligned with the sight line of the first sighting device (15).

5 Claims, 1 Drawing Sheet

FIRE CONTROL SYSTEMS

Figure 1:
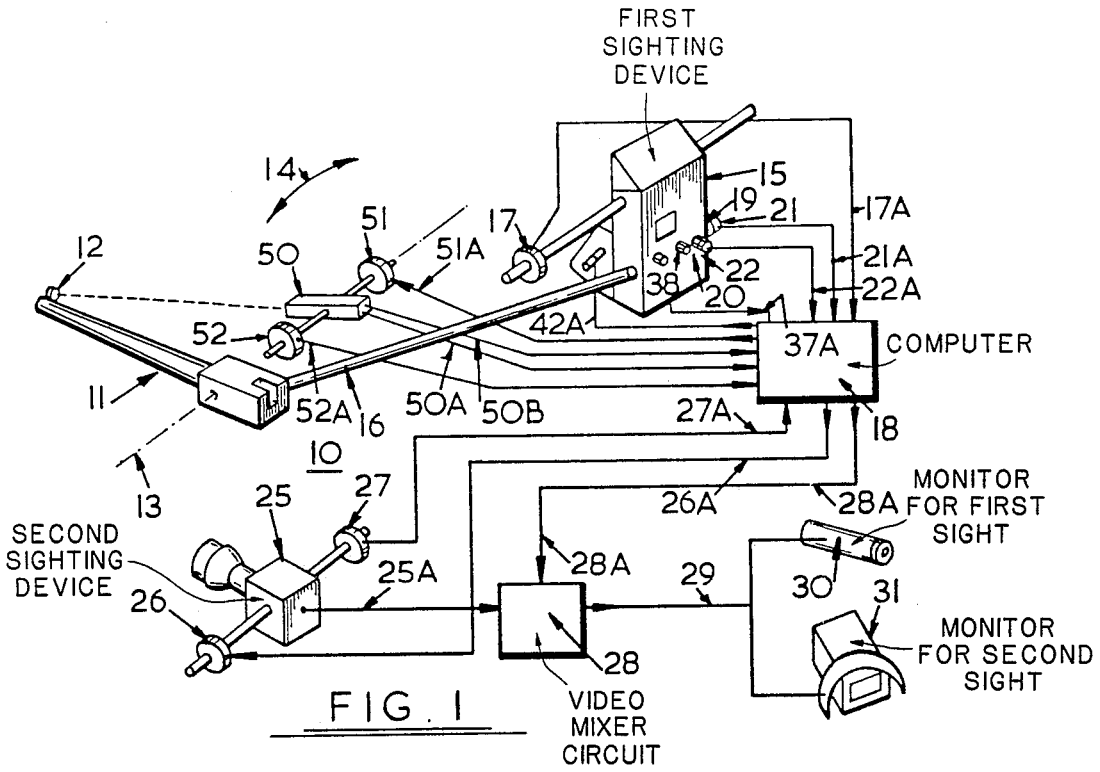

This invention relates to fire control systems.

In the field of tank fire control systems the gunner views and aims through a visual sight having a sight line which is nominally aligned with the barrel axis of the gun. The sight incorporates an optical ballistic graticule and is interconnected with the gun by a tracking link to provide that any elevational adjustments are effective on the gun and sight in common. Azimuthal adjustments are also effective in common by the gun and sight each being mounted on a common platform, namely the tank turret which of course is rotatable in azimuth.

Constancy of the alignment between barrel axis and sight line is extremely important for accurate operation of the system and because the gun, at least at its muzzle end, tends to bend during use it is known that the gunner should regularly effect an alignment check and correction procedure. This procedure involves moving the gun to a predetermined elevational position at which it becomes possible to direct a light beam from a source at or near the sight towards a small mirror mounted on the gun barrel at its muzzle end such that the reflected light beam enters the sight. At this predetermined elevational position the ballistic graticule defines a marker and the gunner views the reflected light beam in the sight and effects a visual comparison of the beam position with respect to the marker, identity of position denoting alignment accuracy and non-identity of position denoting alignment error. If necessary alignment correction is then effected by manual adjustment of two knobs until such time as identity of position is established to the visual satisfaction of the gunner. The two knobs effect orthogonal movements (elevational and azimuthal) of the lens defining the sight line in the sight.

When the sight line and barrel axis are in alignment the sight is in a condition to be aimed at a target the range of which is determined by a laser rangefinder forming part of the sight. By determining the target range in this manner the sight can then be elevated to the corresponding range gradation of the ballistic graticule and the gun fired. Because the ballistic graticule has a myriad of gradations it can be difficult for the gunner to select the correct gradation and where the target range value falls between adjacent gradations on the ballistic graticule the gunner requires to effect an interpolation. Each of these procedures is subject to human error and to eliminate this a known improved form of fire control system electronically generates an aiming mark, usually in the form of an ellipse, which is injected into the sight in the plane of the ballistic graticule at the pertinent elevational position for the target range as determined by a ballistic computer. With this system the gunner merely has to centre the elliptical aiming mark on the target before firing the gun. The ballistic computer receives the target range signal from the laser rangefinder and by means of known ballistic equations establishes the required position of the elliptical aiming mark with respect to the ballistic graticule of the sight.

It will be appreciated from the foregoing that if the sight is out of alignment with the gun barrel axis the aiming mark as defined by either the ballistic graticule or the electronic computer-controlled generator will be erroneously located. The alignment check and correction procedure is therefore very important.

Furthermore tanks conventionally incorporate several other sights such as a thermal imaging sight and a commander's sight each of which is brought into alignment with the gunner's sight by virtue of the two adjustment knobs of the gunner's sight being graduated and the scale markings thereon after completion of the check and correction procedure being issued by the gunner to the operator or operators of the other sights in the tanks, corresponding adjustments of the sight lines of these other sights then being effected manually either by means of corresponding adjustment knobs therein or by entry of numeric figures into a computer controlling these sights. Such corresponding sight alignments are particularly important in the case of a thermal imaging sight which may be the only sight effectively operational during darkness or poor visibility conditions in conjunction with the laser rangefinder part of the gunner's sight. Clearly if there is misalignment in this situation between the two sights the rangefinder may provide a range reading of an erroneous target and if the thermal imaging sight is also misaligned with the gun muzzle axis firing accuracy of the gun must be totally lost.

Accordingly the known fire control systems suffer from a number of disadvantages. For example intersight alignment is dependent upon accurate interpretation by the gunner of the scale markings on the two adjustment knobs of the gunner's sight and is further dependent upon accurate use of the gunner-supplied information by the other sight operator or operators. The known alignment check and correction procedure for the gunner's sight also suffers from a number of disadvantages. For example, it can only be carried out when the gun is at its predetermined elevational position because only then does the mirror on the muzzle end of the gun lie in the relevant part of the field of view of the sight. Furthermore, the procedure relies upon the gunner's visual interpretation of what constitutes identity of beam position on the marker this being a variable factor depending upon the gunner's physical and/or mental health. Also, the procedure is local to the visual sight concerned and does not provide any means of establishing alignment of any of the other sights which are conventionally provided in a tank. Of necessity there is a time interval between the procedure being effected and the gun being arranged for firing and during this interval the gun barrel may bend so that alignment accuracy is lost; and under combat conditions where repeated firing of the gun is of greatest importance there is insufficient time to carry out the procedure on an intermittent basis so that when accuracy is paramount alignment error goes unchecked and is liable to increase progressively because of the repeated firing.

It is an object of the present invention to provide an improved fire control system wherein one or more of the foregoing disadvantages are obviated or mitigated.

In one of its aspects the present invention provides a fire control system comprising a platform on which are mounted for elevational movement a gun and first and second sighting devices, each sighting device having its sight line nominally aligned with the barrel axis of the gun and being interconnected with the gun by a tracking link which is arranged to provide for elevational adjustments to be effective in common, and wherein said first sighting device comprises a lens defining the sight line thereof, a graticule defining an alignment mark and an alignment-adjustment mechanism coupled to said lens and operable by an operator to effect relative adjustment of said alignment mark with respect to the sight line of said first sighting device, said gun comprises a muzzle reference mirror at its muzzle end and a direction finder is carried by said first sighting device, the direction finder and first sighting device together being arranged to enable the position of an image in the said muzzle reference mirror to be identified with respect to said alignment mark and said alignment-adjustment mechanism being operable to effect alignment of said mark with said image seen in said muzzle reference mirror position, said mechanism comprising signal-generating sensors arranged automatically to provide alignment-adjustment identification signals, and wherein said second sighting device comprises an electronic graticule generator coupled to receive said identification signals and operable to locate the electronically-generated graticule in said second sighting device so that the sight line thereof is automatically aligned with the sight line of the first sighting device.

Preferably said first sighting device comprises a laser rangefinder the transmitted laser beam of which is positionally predetermined in said first sighting device and said electronic graticule generator of said second sighting device is further arranged elevationally to displace said electronic graticule with respect to the sight line thereof by an amount corresponding to the range of a designated target, and azimuthally to displace said electronic graticule with the sight line as may be required for ballistic reasons.

According to another of its aspects the present invention provides a fire control system comprising a platform on which are mounted for elevational movement a gun and a sighting device, the sighting device incorporating generator means providing an electronically-generated graticule therein, having its sight line nominally aligned with the barrel axis of the gun, and being interconnected with the gun by a first tracking link which is arranged to provide for elevational adjustments to the effective in common, and wherein the gun has a muzzle reference mirror at its muzzle end and a direction-finder is carried by the platform adjacent the gun mounting, the direction finder being mounted for elevational movements, being interconnected with the gun by a second tracking link which is arranged to provide for elevational adjustments to be effective in common, and having its sighting axis directed towards the muzzle reference mirror throughout the range of elevational movements of the gun, the direction finder being arranged to provide an electrical signal representative of the position of the muzzle reference mirror axis with respect to a datum position throughout the range of elevational movements of the gun, control means being arranged to receive the electrical signal from the direction finder and being coupled to control said generator means so as continuously and automatically to adjust the position of the graticule in the sighting device to compensate for alignment errors.

The first and second tracking links may each be wholly mechanical or one or both links may be servo-controlled hydraulic, pneumatic or electric. In the case where the second tracking link is servo-controlled and the direction-finder incorporates a goniometer the electrical signal from the goniometer may be used as an error signal for the servo. In this case the direction finder also requires an elevation angle sensor to provide an electrical signal representative of the elevation of the goniometer, the axis of the mirror being the algebraic sum of angle sensor output and the goniometer vertical error signal, and the goniometer azimuth signal by itself providing azimuthal alignment deviation from the datum position.

The sighting device may operate in the infrared or in the visible part of the spectrum and it will be evident that the electrical signal provided by the direction finder can be used to effect automatic alignment error compensation in any number of other sights where there is an electronically-generated graticule.

In the case where the sighting device is the gunner's primary visual sight it is preferred that this sight remain operational in the event of failure of the electronically-generated graticule therein. To achieve this the primary visual sight is provided with an optical ballistic graticule which is additional to and used as an alternative to the electronically-generated graticule but which is manually alignable with the muzzle reference mirror.

Figure 2:
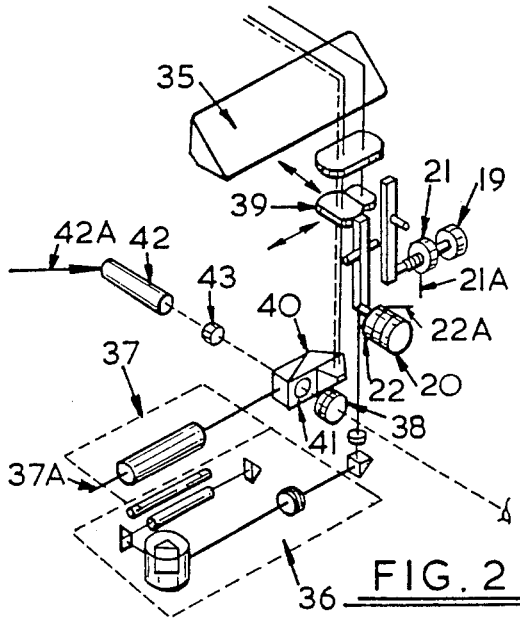

An embodiment of the present invention will now be described by way of example with reference to the accompanying drawing, in which:

FIG. 1 is a diagrammatic and partly schematic view of a fire control system; and FIG. 2 illustrates a detail of FIG. 1.

In FIG. 1 the system comprises a gun 11 having a reference mirror 12 at its muzzle end the other end of the gun 11 being trunnion-mounted for elevational movements about axis 13 relative to a platform 10 which carries the trunnions and which is rotatable in azimuth as denoted by arrow 14. The platform 10 also carries a first sight 15 which is coupled to gun 11 by a tracking link 16 so that sight 15 and gun 11 are linked for elevational movements in common. Link 16 is illustrated as a mechanical component but this need not be the case. Elevational movements of the sight 15 are sensed by a sensor 17 and fed along link 17A to a computer 18. As will be explained in greater detail with reference to FIG. 2 the sight 15 further comprises two alignment adjustment knobs 19, 20 with respective sensors 21, 22 the electrical output signals of which are fed to computer 18 along links 21A, 22A respectively.

Also mounted on the platform 10 is a second sight 25 which in this instance is in the form of a thermal imager and is connected to the gun 11 by a tracking link which is an electrically controlled servo 26 which receives a drive signal from computer 18 via link 26A. An elevational sensor 27 is connected to sight 25 and feeds an elevation signal to computer 18 via link 27A. The imager 25 produces a video output signal on link 25A which is applied to a video mixer circuit 28 to which is applied on link 28A an electronic graticule signal from computer 18 and the output from mixer circuit 28 is applied via link 29 to a monitor 30 intended for intermittent use by the operator of sight 15 (i.e. the gunner) and a monitor or display 31 intended for regular use by a second operator.

As is shown in FIG. 2 the sight 15 is periscopic having a common top mirror (or prism) 35 via which both laser and visible light beam pass. Although the full details of the laser rangefinder are not illustrated the laser transmitter is designated by numeral 36 and the laser receiver by numeral 37. Visible light received by the sight 35 is transmitted to the operator's eyepiece 38 via a lens assembly 39 and as will be evident from the laser beam paths illustrated both transmitted and received laser beams also pass through assembly 39. Received laser light is separated from received visible light by prism assembly 40 which also carries a ballistic graticule 41. An electronic graticule is superimposed on ballistic graticule 41, that is in the plane thereof by means of an electronic generator 42 and associated lens 43, the generator 42 being under the control of computer 18 by means of a signal on link 42A (see FIG. 1). The output signal from the laser rangefinder is also transmitted to computer 18 via link 37A.

In order to align the sight 15 with the barrel axis of the gun 11 the lens assembly 39 is moved in accordance with the known alignment check procedure by means of the two knobs 19, 20 but in accordance with the present invention sensors 21, 22 provide electrical alignment signals to computer 18 which automatically effects corresponding alignment compensation to occur in sight 25 by virtue of realignment of the electronic graticule injected by mixer circuit 28.

In accordance with the second aspect of the present invention the platform 10 also carries a direction finder 50 which is arranged for elevational movements about axis 13 and which is connected to gun 11 by an electronic tracking link incorporating servo 51 driven via link 51A from computer 18 and elevation sensor 52 coupled to computer 18 via link 52A such that direction finder 50 continuously follows movements of the gun 11 and continuously views the muzzle reference mirror 12. The electrical output signals from the direction finder 50 are fed via lines 50A, 50B to the computer 18. The direction finder 50 comprises an auto-collimator or goniometer so that when barrel bending occurs in the vertical plane the misalignment signal emerges on line 50A whereas azimuthal barrel bending produces a misalignment signal on line 50B. With the misalignment signalled information computer 18 can provide a continuous and automatic compensating correction signal on link 42A to the electronic graticule produced by generator 42 in sight 15 and on link 28A to the electronic graticule for sight 25.

It will be evident from the foregoing that a number of components have been described generically in relation to their function. This is because these components are individually known and may be implemented in any one of a number of embodiments. The present invention is concerned with the combination of many components and to their functional interrelationship.

What is claimed is:

1. A fire control system comprising a platform on which are mounted for elevational movement a gun and first and second sighting devices, each sighting device having its sight line nominally aligned with the barrel axis of the gun and being interconnected with the gun by a tracking link which is arranged to provide for eleveational adjustments to be effective in common, and wherein said first sighting device comprises a lens defining the sight line thereof, a graticule defining an alignment mark and an alignment-adjustment mechanism coupled to said lens and operable by an operator to effect relative adjustment of said alignment mark with respect to the sight line of said first sighting device, said gun comprises a muzzle reference mirror at its muzzle end and a direction-finding means is incorporated within said first sighting device, the direction finding means being arranged to enable the position of an image in the said muzzle reference mirror to be identified with respect to said alignment mark and said alignment-adjustment mechanism being operable to effect alignment of said mark with said image seen in said muzzle reference mirror position, said mechanism comprises signal-generating sensors arranged automatically to provide alignment-adjustment identification signals, and wherein said second sighting device comprises an electronic graticule generator coupled to receive said identification signals and operable to locate the electronically-generated graticule in said second sighting device so that the sight line thereof is automatically aligned with the sight line of the first sighting device.

2. A system as claimed in claim 1 wherein said first sighting device comprises a laser rangefinder the transmitted laser beam of which is positionally predetermined in said first sighting device and said electronic graticule generator of said second sighting device is further arranged elevationally to displace said electronic graticule with respect to the sight line thereof by an amount corresponding to the range of a designated target, and azimuthally to displace said electronic graticule with the sight line as may be required for ballistic reasons.

3. A fire control system comprising a platform on which are mounted for elevational movement a gun and a sighting device, the sighting device incorporating generator means providing an electronically-generated graticule therein, having its sight line nominally aligned with the barrel axis of the gun, and being interconnected with the gun by a first tracking link which is arranged to provide for elevational adjustments to the effective in common, and wherein the gun has a muzzle reference mirror at its muzzle end and a direction-finder is carried by the platform adjacent the gun mounting, the direction-finder being mounted for elevational movements, being interconnected with the gun by a second tracking link which is arranged to provide for elevational adjustments to be effective in common, and having its sighting axis directed towards the muzzle reference mirror throughout the range of elevational movements of the gun, the direction-finder being arranged to provide an electrical signal representative of the position of the muzzle reference mirror axis with respect to a datum position throughout the range of elevational movements of the gun, control means being arranged to receive the electrical signal from the direction-finder and being coupled to control said generator means so as continuously and automatically to adjust the position of the graticule in the sighting device to compensate for alignment errors.

4. A system as claimed in claim 3 wherein the second tracking link is servo-controlled and the direction-finder incorporates a goniometer the electrical signal from which is used as an error signal for the servo.

5. A system as claimed in claim 4 wherein the direction finder also incorporates an elevation angle sensor to provide an electrical signal representative of the elevation of the goniometer, the axis of the mirror being the algebraic sum of angle sensor output and the goniometer vertical error signal, and the goniometer azimuth signal by itself providing azimuthal alignment deviation from the datum position.

* * * * *